US006059403A

United States Patent [19]

Bürgin

[11] Patent Number: 6,059,403

[45] **Date of Patent: *May 9, 2000**

[54] LIQUID CARTRIDGE AND PRINT HEAD FOR AN INK-JET PRINTER

[75] Inventor: Markus Bürgin, Uster, Switzerland

[73] Assignee: Pelikan Produktions AG, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/771,801

[22] Filed: Dec. 20, 1996

[30] Foreign Application Priority Data

Dec. 21, 1995 [DE] Germany ..... 195 48 032

[51] Int. Cl.[7] ..... B41J 2/175; B41J 2/165

[52] U.S. Cl. ..... 347/87; 347/35

[58] Field of Search ..... 347/84, 85, 86, 347/87, 35

[56] References Cited

U.S. PATENT DOCUMENTS

| | | | |
|---|---|---|---|
| 5,619,239 | 4/1997 | Kotaki et al. | 347/86 |
| 5,745,139 | 4/1998 | Sasaki | 347/86 |

FOREIGN PATENT DOCUMENTS

| | | | |
|---|---|---|---|
| 560729 B1 | 9/1993 | European Pat. Off. . | |
| 605 183 | 7/1994 | European Pat. Off. | 347/86 |
| 635373 A1 | 1/1995 | European Pat. Off. . | |
| 56-118868 | 9/1981 | Japan | 347/35 |
| 59-45160 | 3/1984 | Japan | 347/35 |
| 3-288652 | 12/1991 | Japan . | |
| 5-104735 | 4/1993 | Japan | 347/86 |

*Primary Examiner*—N. Le
*Assistant Examiner*—Judy Nguyen
*Attorney, Agent, or Firm*—Fay, Sharpe, Fagan, Minnich & McKee, LLP

[57] ABSTRACT

The liquid cartridge 1 of the invention has a housing 25 containing a liquid. A wall 27 of the cartridge has an opening 31 for placement on a stub 11 of a print head 2. The opening 31 also has a sealing ridge 32 protruding in the direction of an axis of the opening 31 which exerts a sealing effect against a frontal surface 21 of a packing ring 17 of the print head 2. A locking shoulder 33 approximately parallel to the wall 27 in which the opening is formed is engaged with a counter shoulder 34 of the print head 2. The liquid cartridge formed according to the present invention is manufactured economically and is easily positioned in a proper position in the print head.

16 Claims, 2 Drawing Sheets

FIG. 2
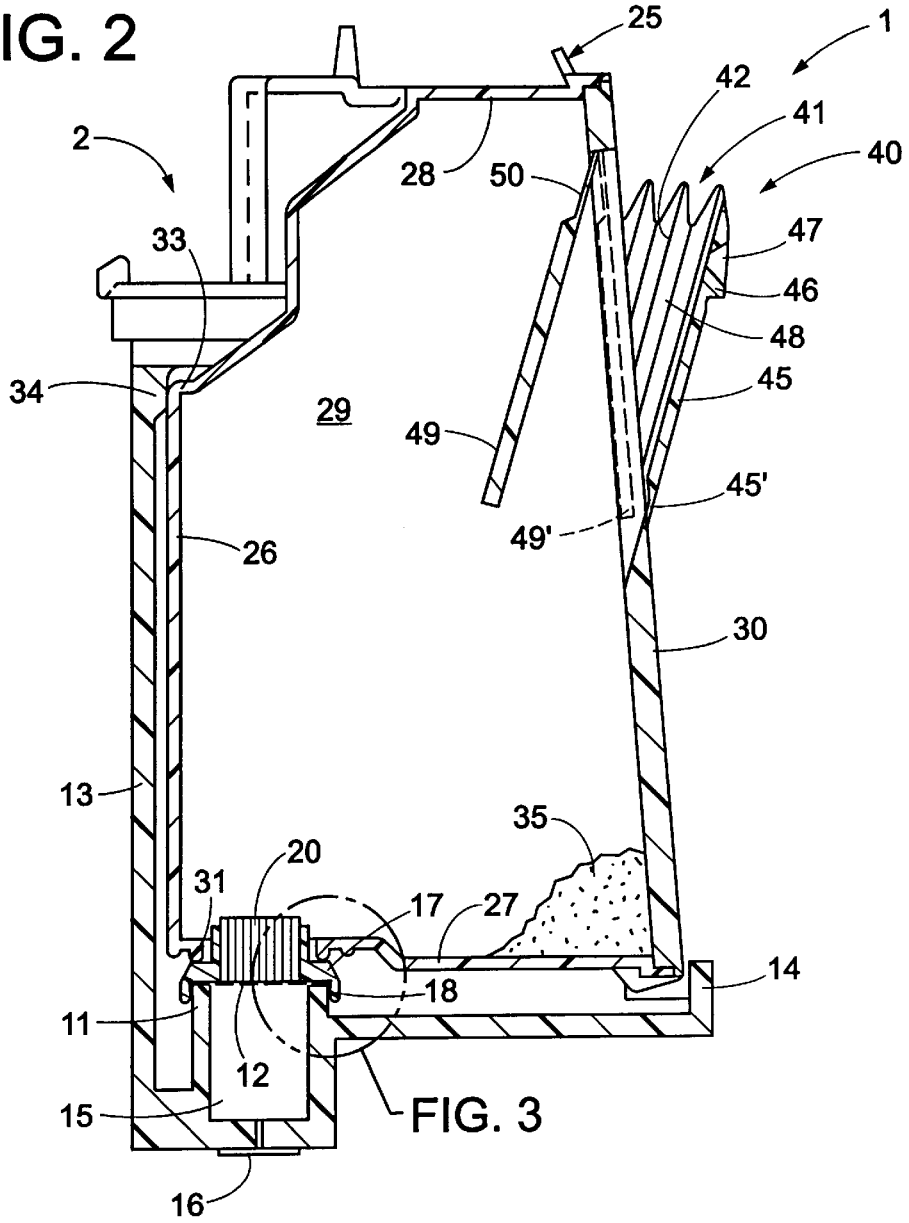
FIG. 3
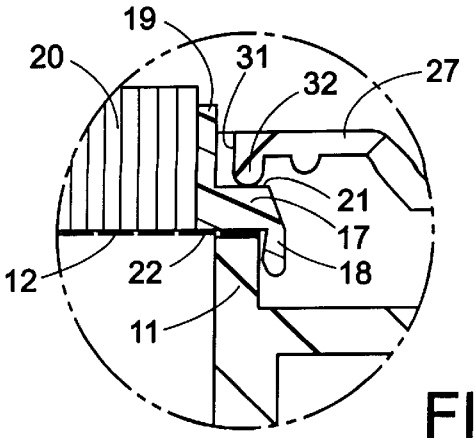
FIG. 3

LIQUID CARTRIDGE AND PRINT HEAD FOR AN INK-JET PRINTER

BACKGROUND OF THE INVENTION

The invention pertains to the art of ink-jet printers and, more particularly, to an ink cartridge and a print head for receiving the ink cartridge of an ink-jet printer.

An example of a removable ink cartridge for a print head of an ink-jet printer is described in EP-A-560 729. This ink cartridge has a housing with an opening in one wall of the housing in order to slip the cartridge onto a tubular stub of the print head. A packing ring for sealing is placed on an end of the tubular stub. The sealing ring abuts against a shoulder formed on a cylindrical outer surface of the opening and against the cylindrical outer surface of the opening. On opposing side walls of the cartridge and the print head are engaging members. In particular, the cartridge has spherical cap-shaped protrusions which engage with mating recesses in the side walls of the print head.

Another example of an ink-jet printer cartridge is shown in EP-A-635 373. This print head also has a tubular stub around which is placed an O-ring for radial sealing between a cylindrical opening of the cartridge and a tubular stub of the print head. A fibrous ink inducing element is inserted in a casing connected to the cylindrical opening of the cartridge.

Both of the above-described cartridges have the drawback that narrow tolerances must be observed for both the position of the tubular stub of the print head as well as for the position of the opening of the cartridge.

SUMMARY OF THE INVENTION

It is an object of the present invention to perfect a liquid cartridge and a print head such that cartridge manufacture is simplified. It is also an object of the present invention to address the problems of positioning the liquid cartridge with respect to the print head.

Still other advantages and benefits of the invention will become apparent to those skilled in the art upon a reading and understanding of the following detailed description.

According to one aspect of the present invention, an ink cartridge for a print head of an ink-jet printer includes a housing with a bottom wall, a first wall, and a second wall; a first opening for insertion of a droplet generator formed in the first wall; and a pump organ with an air supply opening formed in the second wall, the pump organ including a folding bellows formed in a single-piece onto the second wall with the bellows extending at an incline with respect to the second wall and formed in a U-shape having two legs connected at free ends to the second wall.

According to another aspect of the present invention, a print head for an ink-jet printer, for installation of a liquid cartridge, the print head includes a stub closed by means of a sieve; an elastomer sealing ring placed on the stub, the sealing ring supported on a front surface of stub and having a surface against which a sealing ridge of the liquid cartridge exerts a sealing action; and a counter shoulder extending substantially parallel to the surface of the sealing ring for locking of a locking shoulder of the liquid cartridge.

BRIEF DESCRIPTION OF THE DRAWINGS

Following is an exemplary embodiment of the invention, which will be described in detail in this specification and illustrated in the accompanying drawings which form a part hereof, wherein:

FIG. 2 is a cross-section taken along line II—II in FIG. 1; and,

FIG. 3 is an enlargement of a portion of the cross-section of FIG. 2.

DETAILED DESCRIPTION OF THE PREFERRED EMBODIMENT

Figure 1:
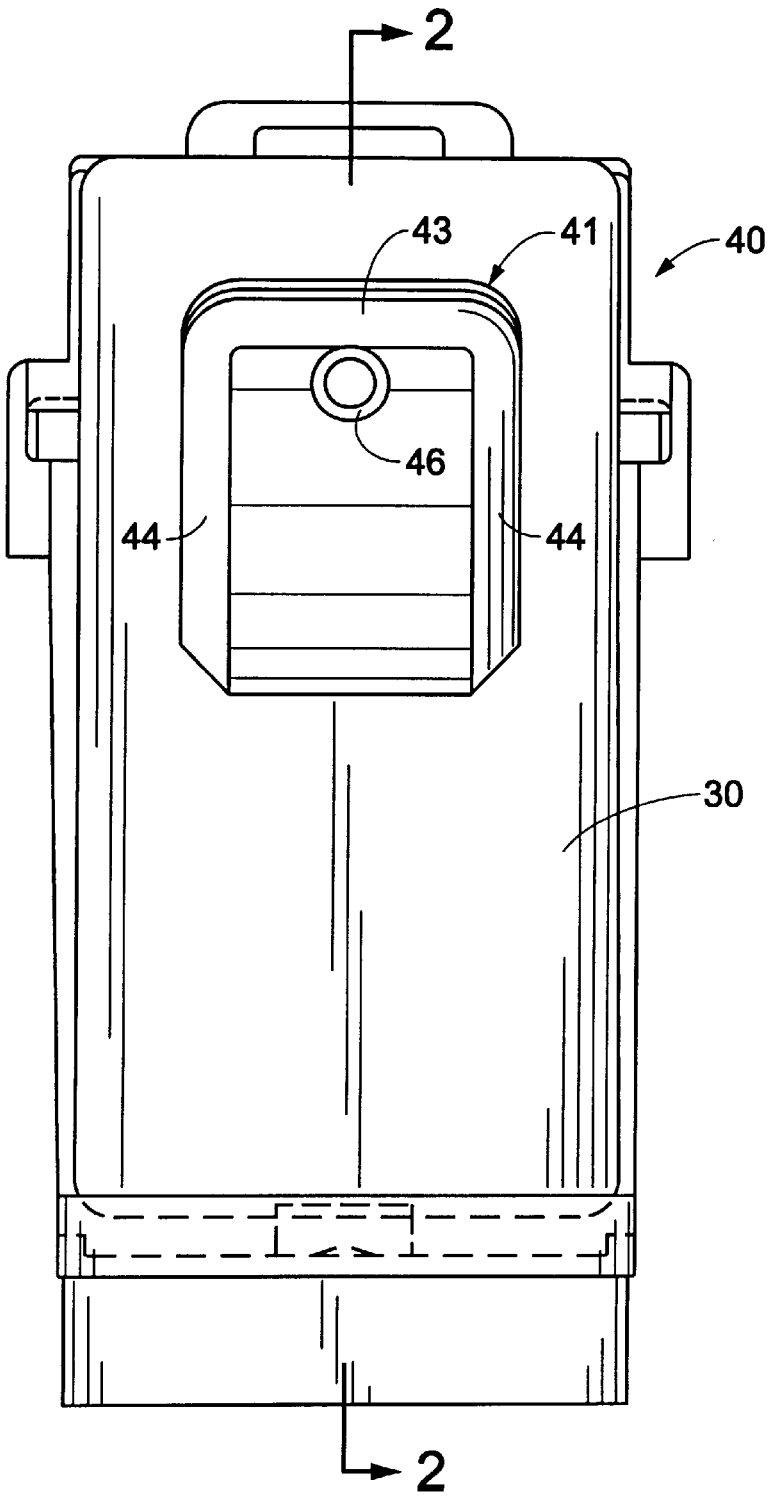
FIG. 1 is a frontal view of the ink cartridge mounted in the print head.

Referring now to the drawings wherein the showings are for the purposes of illustrating the preferred embodiment of the invention only and not for purposes of limiting same, in the FIGURES, an ink cartridge 1, represented by bold lines, is installed in a droplet generator, in particular in a print head 2, indicated by thin lines, of an ink-jet printer. The print head 2 has a tubular conduit 11 or with a front surface covered by means of a sieve 12. The housing 13 of the print head 2, as shown in FIG. 2, is open toward the right side of the FIGURE and has a protrusion 14 on the lower right side. An interior 15 of the conduit 11 is filled with ink and is in fluid communication with an ink-jet plate 16. An elastomer sealing ring 17 with a tubular lug 18 extending from a lower surface is snapped onto the front surface of the conduit 11. The sealing ring 17 also includes an opposite sleeve-shaped lug 19, best illustrated in FIG. 3, in which a fine-pored fibrous wick 20 is inserted. A front end of the wick 20 is in contact with the sieve 12. The sealing ring 17 has a flat annular surface 21 which surrounds the lug 19. An opposing, parallel flat surface 22 of the ring 17 abuts against the front surface of the stub 11.

The cartridge 1 has a housing 25 including a bottom wall 26, four side walls 27, 28, 29, and a welded-on cover-wall, designated as lid 30. The lower side wall 27 has a round opening 31, whose diameter is larger than the diameter of lug 19. An annular sealing ridge 32 with a rounded surface is formed around the opening 31 on the underside of wall 27. The sealing ridge 32 is pressed in an axial direction of the opening 31 and conduit 11 against the annular surface 21 of the sealing ring 17. Although the conduit 11 and the sealing ring 17, as well as the opening 31 and the sealing ridge 32 have been described as being circular in shape, they can also be rectangular without departing from the scope of the invention.

The wall 26 has, at a top end, a stop shoulder 33, which extends approximately parallel to wall 27, and engages a corresponding opposite shoulder 34 of housing 13 of the print head 2. When inserting the cartridge 1 into the print head 2, the lower edge of the lid 30 locks behind the protrusion 14. The cartridge 1 is then pressed into place at the top until the stop shoulder 33 on the cartridge engages with opposing shoulder 34 on the print head housing. In this manner, secure sealing of the opening 31 with respect to the conduit 11 is achieved. Inasmuch as the opening 31 is larger than the projection 19, insertion is made possible by the swivelling movement described above. In addition, manufacturing tolerances in the position of conduit 11 can be accommodated by the relative sizes of the opening 31 and the lug 19. Upon insertion of the cartridge into the print head, wick 20 touches an ink-soaked foam body 35 within the cartridge so that the wick 20 becomes soaked with ink. The wick 20 concurrently acts as a wick and as a filter so that the ink-jets 16 do not become clogged or damaged by particles from the foam body 35.

In the lid 30 of the cartridge, a pump organ 40 is molded on as a single piece. The pump organ 40 has a folding bellows 41, formed by a number of U-shaped folds 42 having thin wall thicknesses. The folds 42 each include a straight-lined cross-piece 43 connected at the ends to two straight-lined, parallel legs 44, illustrated in FIG. 1. The legs 44 have a length which increases from fold 42 to fold 42 in a direction toward the exterior of the cartridge. The folds 42 of the bellows 41 are arranged at an acute angle with respect to the plane of the lid 30. The free ends of the folds 42 pass over into the lid 30. A cover 45 of the folding bellows 41 has a thicker wall thickness than the folds of the bellows. The cover 45 is connected at the bottom to the lid 30 by a film hinge 45'. On the side and at the top, the outermost fold 42 of the bellows 41 is connected to the lid 30. The bellows cover 45 has a projection 46 at a top central portion of the bellows cover with an air supply opening 47 formed therein. After inserting the cartridge 1 into the print head 2, the operator presses on the projection 46 covering the opening 47. As a result, the opening 47 is closed and the bellows 41 are pressed in, so that the interior 48 of the bellows 41 is compressed. Consequently, ink is pressed into the interior 15 of the conduit 11.

In order to prevent any ink from getting into the interior 48 of the bellows 41 during transport, a flap 49 is attached to the interior side of the lid 30 by means of a foil hinge 50. In FIG. 2, this flap 49 is depicted in solid lines in the manner in which it would appear molded at an acute angle prior to installation of the lid 30 on the cartridge. With installation of lid 30, the flap 49 is pressed by the foam body 35 inside the cartridge against the lid 30. (dash-dotted lines in FIG. 2) Thus, the interior 48 of the bellows 41 is closed, except for at least one narrow air gap 49', against the ink containing foam body 35 by the flap 49 which prevents ink from entering the bellows.

The cartridge 1 formed according to the present invention can be produced very economically because great tolerances in the position of the opening 31 and the conduit 11 can be accommodated. Due to engagement of the stop shoulder 33 with the opposing shoulder 34, the cartridge is positioned exactly in the proper position along the axial direction of the opening 31. Thus, secure docking of the upper surface of wick 20 against the foam body 35 is achieved. The sealing ring 17 has the triple functions of sealing, providing spring action for the locking of shoulder 33, 34, and compensation for tolerances in the relative positions of conduit 11 and the opening 31. Finally, the pump organ 40 can be constructed in a very narrow shape allowing the production of very narrow cartridges 1, for example, cartridges for use in multi-color print heads 2.

In addition to use as an ink cartridge for print heads of ink-jet printers, the liquid cartridge 1 formed according to the present invention can also be used for other applications, for example, in dosing instrument for fluids, such as in medical applications.

The invention has been described with reference to a preferred embodiment thereof. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. An ink cartridge for use with an associated print head in an ink-jet printer, the ink cartridge comprising:

a housing enclosing a reservoir for containing ink and including a bottom wall, a first wall, and a second wall;

an opening formed in the first wall adapted for discharging the ink from said reservoir; and, a pump for pumping air into the reservoir and being molded integrally with the second wall, the pump including a depressible cover hinged to the second wall and projecting at an angle outwardly of the second wall, the pump including a folding bellows formed in a U-shape surrounding the depressible cover and including two leas terminating at the second wall, the bellows connecting the cover with the second wall and extending at an incline relative to the second wall.

2. The cartridge according to claim 1 wherein the cover includes an air supply opening in fluid communication with the reservoir via an interior space of the pump.

3. The cartridge according to claim 1 further including a flap extending from the second wall between the folding bellows and the reservoir, the flap together with the second wall forming at least one slot for providing fluid communication between the pump and the reservoir.

4. The cartridge according to claim 1 wherein the folding bellows have a straight-lined cross-piece and two straight-lined, depending, parallel legs.

5. The cartridge according to claim 1 wherein the first wall surrounding the opening has a sealing ridge adapted to axially seal the opening against an elastomer gasket mounted on a conduit of the associated print head.

6. The cartridge according to claim 5 further comprising a third wall having a stop shoulder substantially parallel to the first wall for engaging a corresponding shoulder formed by the associated print head to selectively lock the cartridge to said associated print head.

7. The cartridge according to claim 1 further comprising a third wall having a stop shoulder substantially parallel to the first wall for engaging a corresponding shoulder formed by the associated print head to selectively lock the cartridge to said associated print head.

8. In an ink-jet printer, a print head adapted to receive an associated liquid cartridge having an ink storage chamber, a cartridge opening and a locking shoulder, the print head comprising:

a sieve;

an ink-jet plate;

a conduit extending toward the ink storage chamber and being in fluid communication with the ink jet plate, the conduit including a front surface having an opening covered by said sieve;

an elastomer sealing member disposed on the conduit and forming an extension of the conduit, the sealing member being supported on the front surface of the conduit and having a surface for sealingly engaging against the associated liquid cartridge, the elastomer sealing member including a projecting portion adapted to extend into the liquid cartridge through the cartridge opening upon connecting the liquid cartridge to the elastomer sealing member; and, a counter shoulder extending substantially parallel to the surface of the sealing member for engagement with said locking shoulder of the associated liquid cartridge to lock the print head with the associated liquid cartridge.

9. The print head according to claim 8 further including a fiber wick received within the sealing member and contacting the sieve, the fiber wick including a plurality of fibers extending substantially perpendicular to a surface of the sieve.

10. The print head according to claim 9 wherein the projecting portion of the sealing member is a sleeve-shaped projection having an exterior diameter which is smaller than the cartridge opening of the liquid associated cartridge.

11. A liquid cartridge according to claim 6 wherein:

the sealing ridge extends in a direction of an axis of the opening for axially sealing against the elastomer gasket of the associated print head.

12. The cartridge according to claim 1 wherein the folding bellows includes a plurality of substantially U-shaped folds.

13. The cartridge according to claim 1 wherein the cover is hinged to the second wall by a film hinge.

14. The cartridge according to claim 1 wherein the cover is an integral extension of the second wall at a point where the cover is hinged to the second wall.

15. The cartridge according to claim 1 wherein the angle is an acute angle.

16. The cartridge according to claim 1 wherein the first wall has a size less than a size of the second wall.

* * * * *